United States Patent [19]

Kashmerick et al.

[11] 4,416,637

[45] Nov. 22, 1983

[54] MARINE STEERING MECHANISM AND ASSOCIATED ACTUATING AND LOCKING DEVICE

[75] Inventors: Gerald E. Kashmerick, Lindenhurst, Ill.; Lawrence E. Zdanowicz, Kenosha, Wis.

[73] Assignee: Outboard Marine Corporation, Waukegan, Ill.

[21] Appl. No.: 282,407

[22] Filed: Jul. 13, 1981

[51] Int. Cl.[3] ..... B63H 21/26

[52] U.S. Cl. ..... 440/60; 440/53; 440/61; 114/150; 74/480 B

[58] Field of Search ..... 114/144 R, 150; 440/53, 440/60, 61, 58; 188/67; 192/8 R; 244/78; 74/480 B

[56] References Cited

U.S. PATENT DOCUMENTS

| | | | |
|---|---|---|---|
| 1,062,561 | 5/1913 | Williams | 192/8 R |
| 3,654,889 | 4/1972 | Bergstedt | 440/61 |
| 3,847,108 | 11/1974 | Shimanckas . | |
| 3,986,475 | 10/1976 | Heiser | 114/144 R |
| 4,041,889 | 8/1977 | Blanchard | 440/61 |
| 4,276,034 | 6/1981 | Kashmerick | 440/53 |

FOREIGN PATENT DOCUMENTS

| | | | |
|---|---|---|---|
| 710182 | 8/1931 | France | 192/8 R |
| 131356 | 8/1919 | United Kingdom | 192/8 R |
| 501449 | 2/1939 | United Kingdom | 192/8 R |

*Primary Examiner*—Trygve M. Blix
*Assistant Examiner*—Stephen P. Avila
*Attorney, Agent, or Firm*—Michael, Best & Friedrich

[57] ABSTRACT

A marine propulsion device comprises a steering member and a steerable member including a propeller. A steering mechanism operatively connects the steering member with the steerable member and includes an actuating and locking device. The actuating and locking device comprises a cylinder having opposite first and second end portions and a piston which is mounted for reciprocative movement within the cylinder between the first and second end portions. A drive assembly operatively connects the piston with the movable steering member to effect reciprocative movement of the piston in response to steering member movement. A driven mechanism operatively connects the piston with the steerable member such that piston reciprocation is transmitted into movement of the steerable member. The actuating and locking device includes hydraulic supply and hydraulic discharge systems which conduct hydraulic fluid into and out of the cylinder end portions in response to piston reciprocation occasioned by operation of the steering member. However, in the absence of operation of the steering member, the hydraulic discharge system locks the piston against movement in the cylinder, thereby also locking the steerable member. Unwanted steering movements caused by forces originating in or acting upon the steerable member are thus prevented.

20 Claims, 9 Drawing Figures

MARINE STEERING MECHANISM AND ASSOCIATED ACTUATING AND LOCKING DEVICE

BACKGROUND OF THE INVENTION

The invention generally relates to marine propulsion devices and to steering mechanisms associated therewith. The invention also generally relates to actuating and locking devices adapted for marine as well as non-marine applications. More particularly, the invention relates to marine steering mechanisms with locking or "no back" arrangements, and, still more particularly, to such arrangements adapted for use in stern drive units.

DESCRIPTION OF THE PRIOR ART

Attention is directed to the following United States patents in which marine steering arrangements with locking or "no-back" arrangements are disclosed:

Shimanckas, U.S. Pat. No. 3,774,571, Nov. 27, 1973
Shimanckas, U.S. Pat. No. 3,669,058, June 13, 1972
Armantrout et al, U.S. Pat. No. 3,182,629, May 11, 1965

Attention is also directed to the following United States patents in which various marine stern drive units are disclosed:

Nossiter, U.S. Pat. No. 3,826,219, July 30, 1974
Shimanckas, U.S. Pat. No. 3,847,108, Nov. 12, 1974
Bergstedt, U.S. Pat. No. 3,857,357, Dec. 31, 1974
Kroll, U.S. Pat. No. 3,977,356, Aug. 31, 1976
Nossiter, U.S. Pat. No. 4,037,558, July 26, 1977

Attention is further directed to the following United States patents in which various actuating devices are disclosed:

Kremeller, U.S. Pat. No. 2,479,169, Aug. 16, 1949
Rye, U.S. Pat. No. 2,945,572, July 19, 1960
Forster, U.S. Pat. No. 3,318,426, May 9, 1967

Finally, attention is directed to now pending United States application Ser. No. 34,191, filed Apr. 27, 1979 and entitled STERN DRIVE GEAR BOX AND CLUTCHING ARRANGEMENT. This application is assigned to the assignee of the present invention.

SUMMARY OF THE INVENTION

The invention provides a marine propulsion device comprising a steering member and a steerable member which includes a propeller. Steering means operatively connects the steering member with the steerable member and includes an actuating and locking mechanism. The actuating and locking mechanism includes a cylinder having opposite first and second end portions and a piston operative for reciprocative movement between the first and second cylinder end portions in response to movement of the steering member. Piston reciprocation is, in turn, operative for effecting movement of the steerable member. The actuating and locking mechanism further includes supply means and discharge means which individually communicate with each of the first and second cylinder end portions and which are each adapted for communication with, respectively, a source of hydraulic fluid and a sump. During piston movement, the supply means is operative for conducting hydraulic fluid from the source into the cylinder end portion away from which the piston is moving. However, in the absence of movement of the steering member, the discharge means is operative for locking the piston against movement in the cylinder by blocking the conduction of hydraulic fluid from each of the first and second cylinder end portions. The steerable member is thus effectively locked against movement, absent movement of the steering member. On the other hand, during the movement of the steering member, the discharge means is operative for freeing the piston for movement between the first and second cylinder end portions by affording the conduction of hydraulic fluid to the sump from the cylinder end portion toward which the piston is moving. Movement of the steering member is thus transmitted into movement of the steerable member.

One of the principal features of the invention is the provision of a marine propulsion steering mechanism having an actuating and locking mechanism which readily transmits operator movement of a steering member into movement of a steerable member but which, in the absence of operator movement of the steering member, effectively locks the steerable member against movement.

BRIEF DESCRIPTION OF THE DRAWINGS

FIG. 9 is an enlarged fragmentary view, partially in section, of a modified construction.

Figure 1:
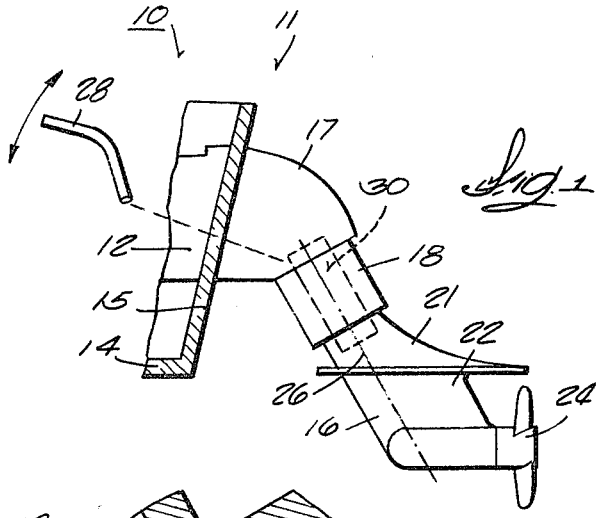
FIG. 1 is a fragmentary side elevation view of a boat-mounted stern drive unit which embodies various of the features of the invention.

Before describing the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

GENERAL DESCRIPTION

Figure 2:
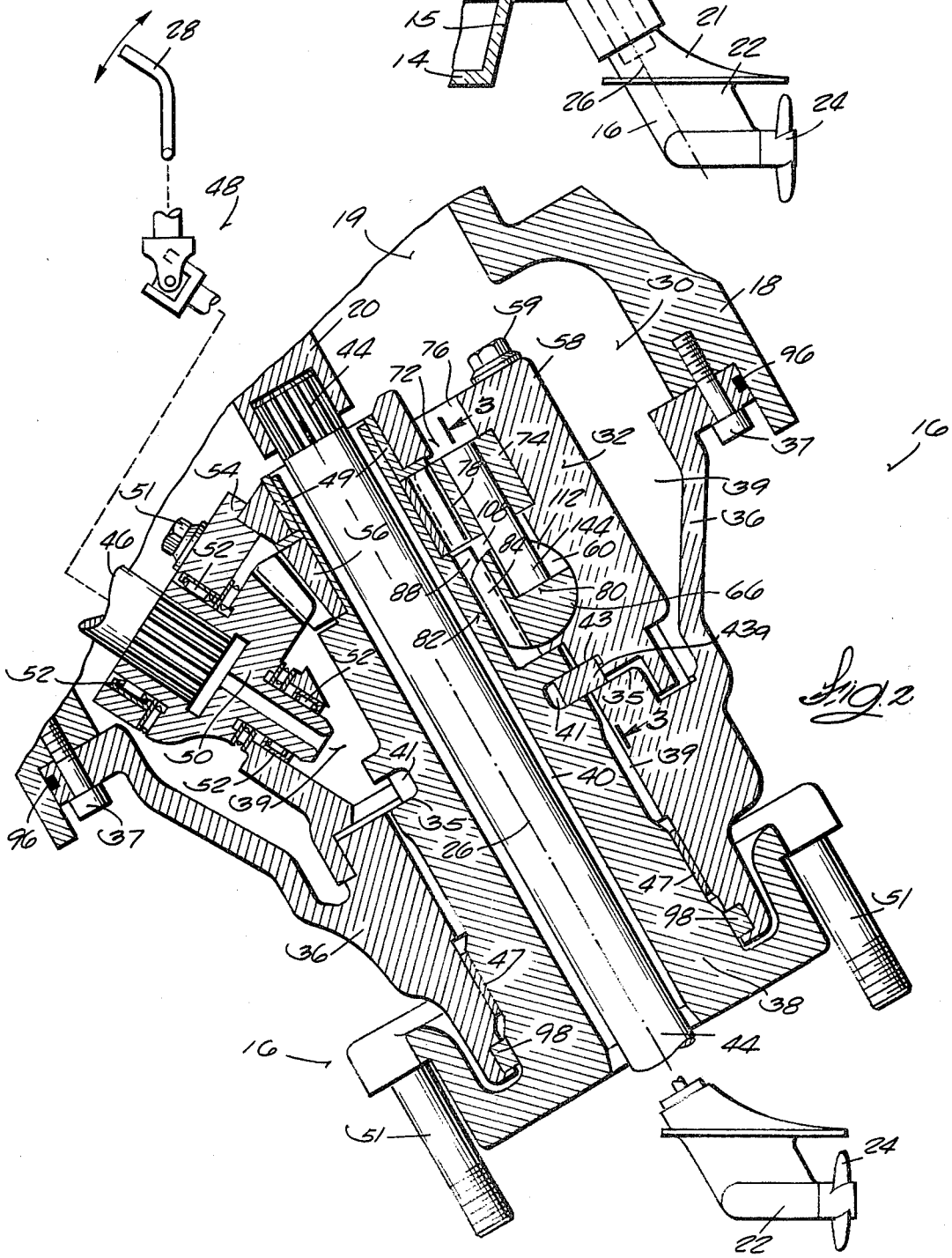
FIG. 2 is an enlarged side view, shown in section and with parts broken away, of the steering mechanism associated with the stern drive unit shown in FIG. 1.

A marine propulsion device 10 is shown in FIGS. 1 and 2. The device 10 includes a steering member 28, or tiller, mounted in a boat 14 for movement by the boat operator in first and second directions (as indicated by arrows in FIGS. 1 and 2). The device 10 also includes a drive unit 11 having a support 12 mounted on the stern of a boat 14 in any desired manner, dependently or independently of the boat transom 15.

In the illustrated embodiment, the support 12 includes an upper housing member 18 (see FIG. 2) which is fixed relative to the boat transom 14. The upper housing member 18 forms an interior bore or cavity 19 in which the drive train 20 of the engine (not shown) extends. As can be seen in FIG. 1, the upper housing member 18 is normally encased or enclosed in a suitable cover assembly 17.

The drive unit 11 also includes a propulsion unit 16 which is carried by the support 12 and which, like the upper housing 18, is normally enclosed in a suitable cover assembly 21 (see FIG. 1).

The propulsion unit 16 includes a steering leg 22 which has a propeller 24 drivingly connected with the drive train 20 of the engine by means of a drive shaft 44 (see FIG. 2) for propelling the boat 14 through the water. In addition, a steering mechanism 30 operatively connects the steering tiller 28 with the steering leg 22 to transmit operator movement of the steering tiller 28 into rotation of the leg 22 relative to the upper housing 18 about axis 26 to steer the boat 14.

While various constructions are possible, in the illustrated embodiment (and referring in particular now to FIG. 2) the steering mechanism 30 includes a generally bell-shaped housing member 36 having an interior cavity 39. The housing member 36 is bolted by suitable means, such as by threaded fasteners 37, to the upper housing 18 of the support 12. By virtue of this connection, the steering housing member 36, like the upper support housing 18, is fixed relative to the transom of the boat 14.

The steering mechanism 30 further includes a generally cylindrical steering tube, or output, member 38 which is supported within the cavity 39 for rotation relative to the housing member 36 about the steering axis 26. The steering tube member 38 includes a bore 40 through which the drive shaft 44 extends for rotation within and independently of the member 38, also about the steering axis 26.

While various constructions are possible, in the illustrated embodiment (see FIG. 2), the steering tube member 38 includes a groove 41 extending circumferentially generally about its midportion. A generally "horseshoe" shaped thrust ring or washer 43 is engaged in the groove 41 (see also FIG. 5) and includes a radially outwardly extending edge portion 43*a*. The housing member 36 includes an annular, inwardly extending flange 35 having a planar upper surface on which the edge portion 43*a* of the thrust washer 43 rests. In addition, an axial bearing 47 is located between the lower portions of the steering tube member 38 and the housing member 36.

To complete the assembly, a retaining cap member 58 is fixedly fitted about the upper portion of the steering tube member 38, being fastened by bolts 59 (only one of which is shown in FIG. 2) to the housing member 36. An additional axis bearing 49 is located between the upper portions of the steering tube member 38 and the retaining cap member 58. The retaining cap member 58 restrains the steering tube member 38 against axial movement along the steering axis 26, while permitting the desired rotation of the steering tube member 38 relative thereto.

The lower end portion of the steering tube member 38 includes a portion which surrounds the lower end portion of the housing member 36 and which includes threaded lugs 51 to which the steering leg 22 is bolted. Rotation of the steering tube member 38 about the axis 26 thus rotates the steering leg 22.

A fluid-tight seal is maintained by gaskets 96 between the point of connection of the steering housing member 36 and the upper support housing 18. A similar fluid-tight seal is maintained by gaskets 98 between the lower portion of the steering tube member 38 and the steering housing member 36. Oil for lubricating the drive train 20 and other adjacent operative components (for example, the thrust washer 43, axial bearings 47 and 49, and drive shaft 44) is confined within the fluid tight cavity 39.

The steering mechanism 30 furter includes a steering shaft 46 suitably coupled to the steering tiller 28, such as by universal linkage arrangement 48, for rotation in response to operation of the tiller 28. The end of the steering shaft 46 is supported by a pair of axial bearings 52, which are, in turn, supported in a bearing housing 54 fixedly connecting to the retaining cap member 58 by a bolt 51. A pinion gear 50 is fixed to the end portion of the steering shaft 46.

The steering mechanism 30 further includes an idler gear 56 supported about the upper portion of the steering tube member 38 for rotation independently of the steering tube member 38 about the steering axis 26. The idler gear 56 is in mesh with the pinion gear 50.

The steering mechanism 30 also includes an actuating and locking device 32 which is operative for transmitting rotation of the idler gear 56 in response to operation of the steering tiller 28 into rotation of the steering tube member 38, and, thus, the steering leg 22 itself. The device 32 is further operative, in the absence of idler gear rotation (i.e., in the absence of steering tiller movement), for locking the steering tube member 38 (and thus the steering leg 22) against rotation.

While various constructions are possible, in the illustrated embodiment (as can now best be seen in FIGS. 2 through 5), the device 32 includes a cylinder 60 which extends in the retaining cap member 58 generally transversely of the steering axis 26 between opposite first and second end portions, respectively 62 and 64. The device 32 also includes a piston 66 mounted for reciprocative movement within the cylinder 60 between the first and second end portions 62 and 64. The piston 66 includes, adjacent to each of its ends, an O-ring 68 or the like making sealing engagement with the interior sidewall of the cylinder 60. Defined by the ends of the piston 66 and the cylinder end portions 62 and 64 are end cavities 63 and 65.

The device 32 further includes drive means 72 operatively connecting the piston 66 with the idler gear 56, such that rotation of the idler gear 56 effects piston reciprocation. While numerous constructions are possible, in the illustrated embodiment (see FIGS. 3 and 4), the drive means 72 includes a drive member 74 which is carried within an elongated slot 76 formed in the retaining cap 58 axially of and above the cylinder 60. The drive member 74 is movable in the slot 76 axially of the path of piston reciprocation (as shown by arrows in FIGS. 3 and 4) in a first direction toward the first cylinder end portion 62 and in a second direction toward the second cylinder end portion 64.

The drive means 72 also includes a series of gear teeth 78 (see FIG. 4) formed on the drive member 74 axially of its path of movement and in mesh with the idler gear 56. As shown by arrows in FIG. 4, rotation of the idler gear 56 in a clockwise direction thus serves to move the drive member 74 in its first direction (i.e. toward the first cylinder end portion 62), and rotation of the idler gear 56 in a counterclockwise direction serves to move the drive member 74 in its second direction (i.e. toward the second cylinder end portion 64).

The drive means 72 further includes linkage means 80 which operatively connects the drive member 74 with the piston 66, so that movement of the drive member 74 in its first and second directions is, in turn, transmitted into corresponding movement of the piston 66. The particular construction of the linkage means 80 in the illustrated embodiment will be described later herein.

The device 32 further includes driven means 82 operatively connected with the piston 66 for effecting rotation of the steering tube member 38 in response to piston reciprocation. While numerous constructions are possible, in the illustrated embodiment, the driven means 82 includes a series of gear teeth 84 (see FIG. 5) formed in the outer wall of the piston 66 axially of its path of reciprocation. A gear segment 88 is fixed generally to the midportion of the steering tube member 38 and is in mesh with the piston gear teeth 84. As shown by arrows in FIG. 5, piston movement toward the first cylinder end portion 62 rotates the steering tube member 38 in a clockwise direction, thus rotating the steering leg 22 in the same direction, and piston movement toward the second cylinder end portion 64 rotates the steering tube member 38 in a counterclockwise direction, thus rotating the steering leg 22 in the same direction.

The device 32 further includes hydraulic fluid supply means 90 and hydraulic fluid discharge means 92, each of which individually communicates with the first and second cylinder end portions 62 and 64. The supply means 90 is adapted for communication with a source of hydraulic fluid, and the discharge means 92 is adapted for communication with a sump. While an external source of hydraulic fluid and an external sump can be utilized, in the illustrated embodiment, the supply of lubricating oil contained within the fluid-tight cavity 39 also serves as the source of noncompressible hydraulic fluid for the device 32. The cavity 39 also serves as the sump.

In this arrangement, the fluid supply means 90 includes an inlet opening 100 and 102 in each of the first and second cylinder end portions 62 and 64. The inlet openings 100 and 102 both communicate directly with the fluid filled interior cavity 39 (see FIG. 3).

The supply means 90 further includes an inlet check valve 101 and 103 in each of the outlet openings 100 and 102. Each inlet check valve 101 and 103 is spring biased toward a closed position (as shown in solid lines in FIG. 5) for preventing the outflow of fluid from each cylinder end portion 62 and 64. Each inlet check valve 101 and 103 is individually movable to an open position (shown in phantom lines in FIG. 5) in response to suction created by movement of the piston 66 away from the associated cylinder end portion 62 and 64. This permits the inflow of fluid from the cavity 39 into the associated cylinder end portion 62 and 64 in response to piston movement away from the associated end portion 62 and 64.

Also in this arrangement, the fluid discharge means 92 includes conduit means 104 for conducting hydraulic fluid from a respective one of the cylinder end portions 62 and 64 back to the fluid filled cavity 39 in response to piston movement toward that respective end portion 62 and 64. While various constructions are possible, in the illustrated embodiment, the conduit means 104 includes a generally elongated outlet opening 108 in the cylinder 60 (see FIGS. 2 and 3) generally intermediate its first and second end portions 62 and 64. This outlet opening 108, like the inlet openings 100 and 102, communicates directly with the fluid filled cavity 39 (see, in particular, FIG. 2).

Figure 3:
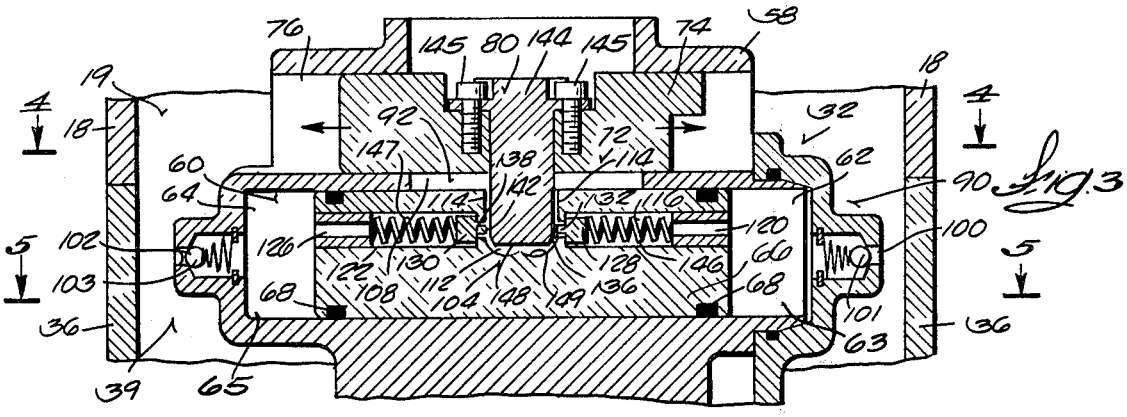
FIG. 3 is a section view of an actuating and locking device incorporated in the steering mechanism shown in FIG. 2 and taken generally along line 3—3 in FIG. 2 with the drive shaft in a generally vertical position.
Figure 4:
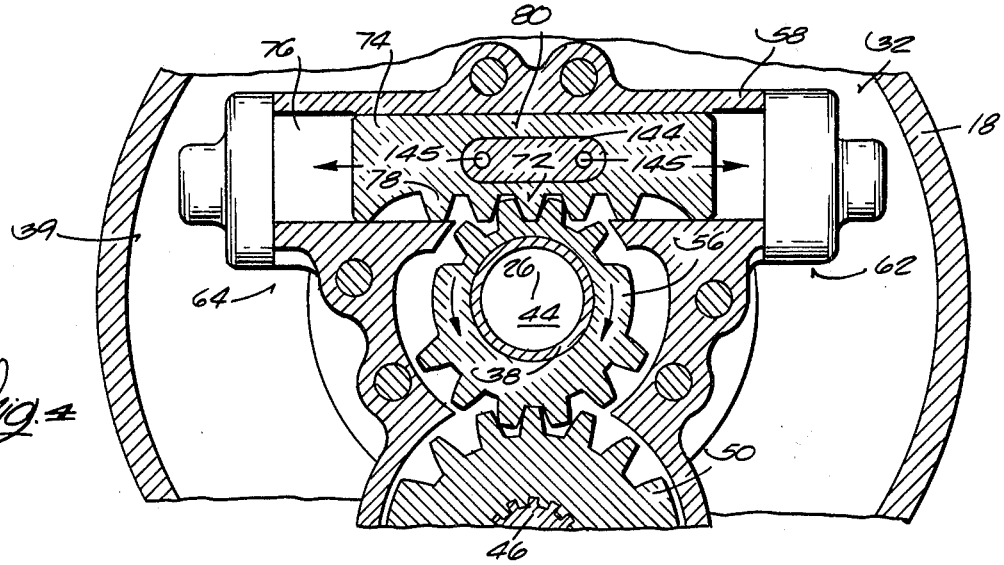
FIG. 4 is a fragmentary section view of the actuating and locking device taken generally along line 4—4 in FIG. 3.
Figure 5:
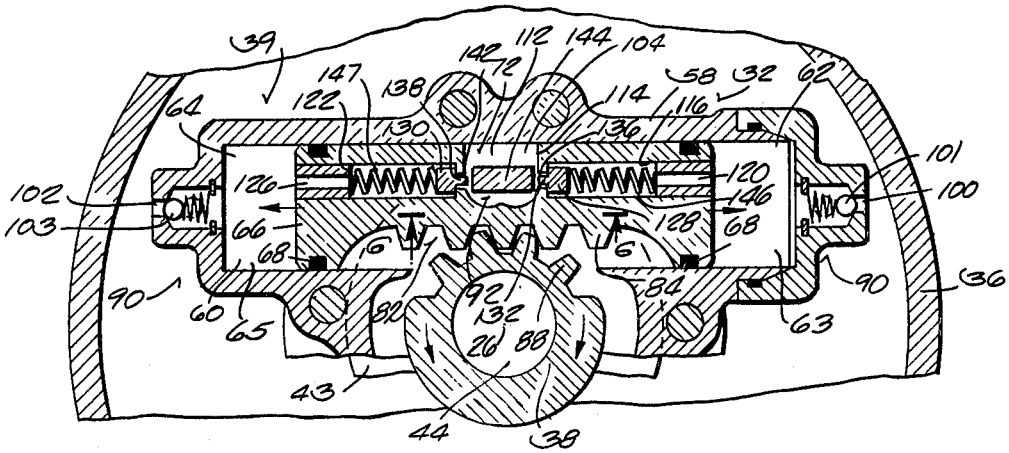
FIG. 5 is a fragmentary section view of the actuating and locking device taken generally along line 5—5 in FIG. 3.

The conduit means 104 also includes outlet conduit means 110 including an outlet passage 112 in the piston 66 (see FIGS. 2, 3, 5, and 6). As best shown in FIGS. 3 and 5, the outlet passage 112 extends transversely of the path of piston reciprocation and is in continuous communication with the elongated cylinder outlet opening 108 during piston movement.

Figure 6:
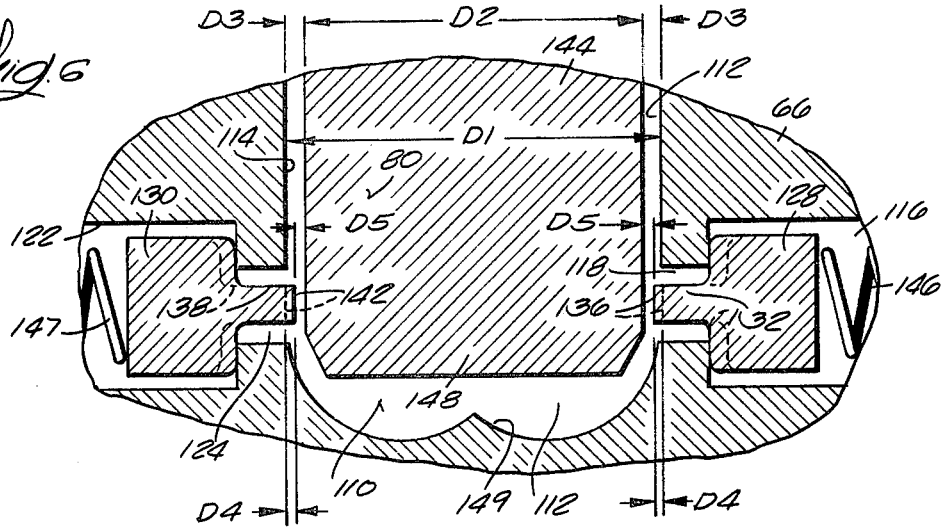
FIG. 6 is an enlarged fragmentary view of a portion of the actuating and locking device, taken generally along line 6—6 in FIG. 5.

The outlet conduit means 110 further includes a first branch passage or bore 116 in the piston 66 (see FIGS. 3 and 5) which extends axially of the path of piston reciprocation between a port 118 (as best shown in FIG. 6) in the piston outlet passage sidewall 114 and a port 120 (see FIG. 7) in the piston end adjacent to the first cylinder end portion 62. In like fashion, the outlet conduit means 110 includes a second branch passage or bore 122 in the piston 66 which extends axially of the path of piston reciprocation between a port 124 in the piston outlet passage sidewall 114 and a port 126 in the piston end adjacent to the second cylinder end portion 64. The ports 118 and 124 are generally diametrically spaced across from each other in the piston outlet passage 112.

As is also shown in FIGS. 3, 5, and 6, the fluid discharge means 92 further includes locking valve means in the form of a first outlet valve 128 in the first piston branch passage 116 and a second outlet valve 130 in the second piston branch passage 122. Each outlet valve 128 and 130 is independently operative between a closed, or seated, position (shown in solid lines in FIGS. 3, 5 and 6), which blocks the conduction of hydraulic fluid by the respective piston branch passage 116 and 122, and an open, or unseated, position (shown in phantom lines in FIG. 6), which permits the conduction of hydraulic fluid by that respective branch passage 116 and 122 in response to piston movement.

In this arrangement, and still referring principally to FIGS. 3, 5 and 6, the linkage means 80 includes springs 146 and 147 which respectively yieldably biases outlet valves 128 and 130 toward their closed positions. The linkage means 80 also includes a first pin 132 operatively connected with the first outlet valve 128 and having an end 136 which generally extends through the port 118 (see FIG. 6). The linkage means 80 also includes a second pin 138 operatively connected with the second outlet valve 130 and having an end 142 which generally extends through the port 124 (again, see FIG. 6).

Each of the first and second pins 138 and 140 is independently movable between a normal position (shown in solid lines in FIGS. 3, 5 and 6) in which the associated pin end 136 and 142 extends outwardly beyond the adjacent branch passage port 118 and 124 and into the piston outlet passage 112, and a displaced position (shown in phantom lines in FIG. 6) in which the associated end 136 and 142 is located generally flush with the vertical plane of the piston outlet passage sidewall 114. Because of the biasing force of the springs 146 and 147, each pin 132 and 138 is spring biased toward its normal position.

As can be seen in FIG. 6, movement of each of the first and second pins 132 and 138 from its normal position to its displaced position moves the associated first and second outlet valve 128 and 130 from its closed position to its open position against the action of the biasing spring 146 and 147.

In the illustrated embodiment, the linkage means 80 further includes an actuator member or finger 144 which is operatively connected with the drive member 74 by means of screws 145 or the like (see FIGS. 3 and 4) and which extends into the piston outlet passage 112. Movement of the drive member 74 in its first and second directions is operative for displacing the actuator member 144 within the piston outlet passage 112 toward either the port 118 or the port 124. As is shown in FIGS. 3 and 6, the end portion 148 of the actuator member 144 terminates short of the lowermost extent of the piston passage 112 and is tapered away from the lower edges of the ports 118 and 124. In addition, the lowermost extent 149 of the piston passage 112 is enlarged.

By virtue of the above described construction, and referring now to FIGS. 3, 5, and 6, in the absence of movement of the steering tiller 28, the springs 146 and 147 bias the outlet valves 128 and 130 toward their closed position. The conduction of hydraulic fluid through either of the first and second branch passages 116 and 122 is thus blocked, and the piston 66 is hydraulically locked against any movement in the cylinder 60. The steering leg 22 is, in turn, effective locked against rotation absent movement of the steering tiller 28. Unwanted steering movements by forces originating in or acting upon the steering leg 22 are thus prevented.

Figure 7:
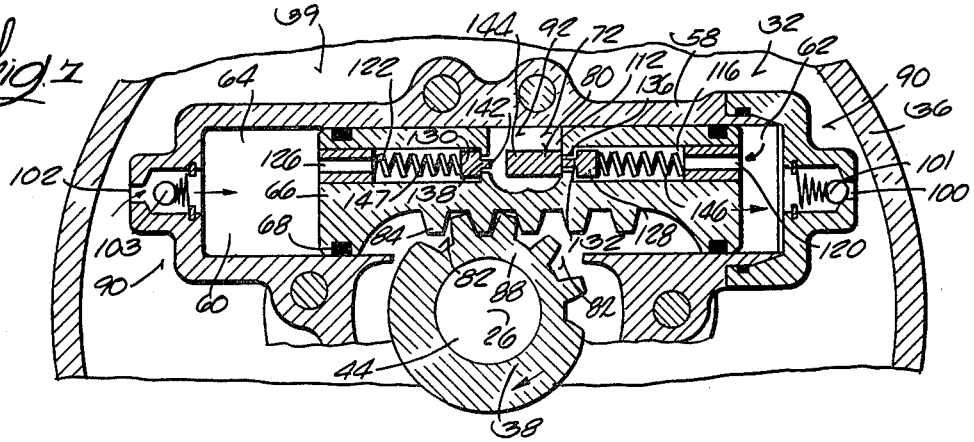
FIG. 7 is a section view of the actuating and locking device, similar to FIG. 5, except showing the piston in a rightwardly displaced position.

Referring now to FIG. 7, movement of the steering tiller 28 to effect movement of the drive member 74 in its first direction (i.e. toward the first cylinder end portion 62) serves to simultaneously move the actuator member 144 toward port 118. Movement of the actuator member 144 in this direction will first bring the actuator member 144 into operative contact with the outwardly extending end 136 of the first pin 132, and will eventually move the first pin 132 from its normal position to its displaced position against the action of the biasing spring 146, thereby opening the first outlet valve 128 to affored the conduction of hydraulic fluid through the first piston branch passage 116.

The above described movement of the drive member 74 in its first direction also brings the actuator member 144 into contact with the sidewall 114 of the piston outlet passage 112 adjacent to the port 118 generally simultaneously with the opening of the first outlet valve 128. The moving actuator member 144 thus serves to press against and displace the piston 66 toward the first cylinder end portion 62. Piston movement in this direction will, in turn, displace hydraulic fluid from the first cylinder end portion 62 through the now open first piston branch passage 116 and out into the fluid filled cavity 39 through the piston and cylinder outlet openings 112 and 108. At the same time, hydraulic fluid will be drawn from the interior cavity 39 into the second cylinder end portion 64 through the inlet opening 102.

Piston movement toward the first cylinder end portion 62 will rotate the steering leg 22 in the clockwise direction through the heretofore described gear teeth 84 and gear 88 arrangement.

Figure 8:
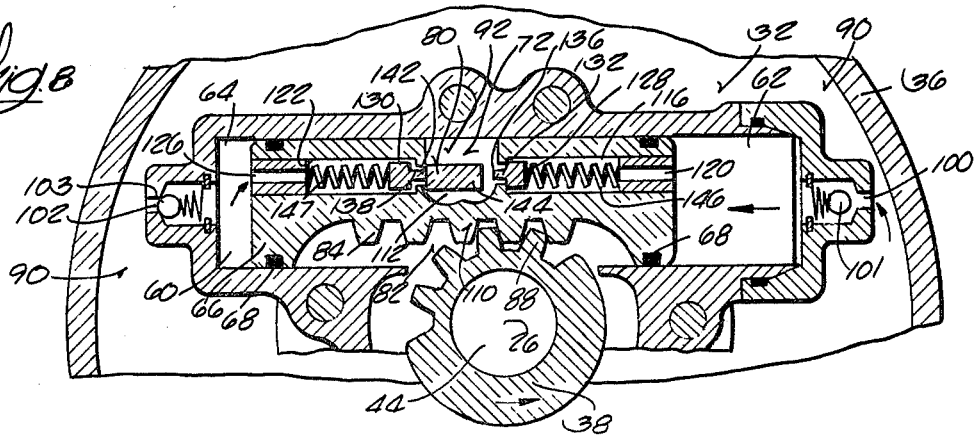
FIG. 8 is a section view of the actuating and locking device, similar to FIG. 5, except showing the piston in a leftwardly displaced position.
Figure 2:
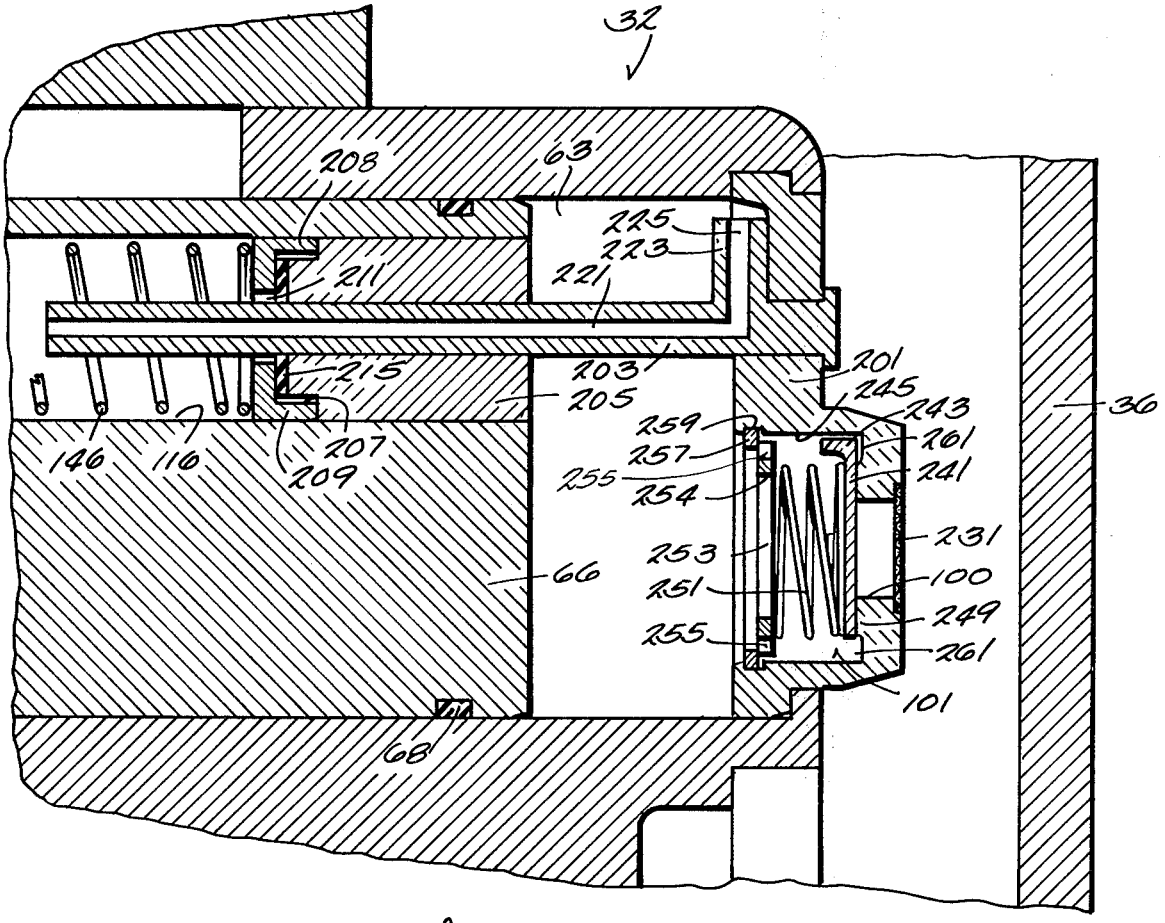

Referring now to FIG. 8, movement of the steering tiller 28 to effect movement of the drive member 74 in its second direction (i.e. toward the second cylinder end portion 64) serves to move the actuator member 144 toward the port 124 of the second piston branch passage 122. Such movement will first bring the actuator member 144 into contact with the outwardly extending end 142 of the second pin 138, and will eventually move the second pin 138 from its normal position to its displaced position against the biasing action of the spring 146. The second outlet valve 130 is thereby moved from its closed to its open position, affording the conduction of hydraulic fluid through the second piston branch passage 122.

Movement of the drive member 74 in its second direction will also bring the actuator member 144 into contact with the sidewall 114 of the piston outlet passage 112 adjacent to port 124 and effects piston movement toward the second cylinder end portion 64. Movement of the piston 66 in this direction will displace hydraulic fluid from the second cylinder end portion 64 through the now open second piston branch passage 122 and to the fluid filled cavity 39 through the piston and cylinder outlet passage 112 and 108, while drawing fluid into the first cylinder end portion 62 through the inlet openings 100.

Piston movement toward the second cylinder end portion 64 will rotate the steering leg 22 in a counterclockwise direction through the heretofore described gear teeth 84 and gear 88 arrangement.

The relative distances the actuator member 144 travels in response to tiller operation to open the outlet valves 128 and 130 and effect piston movement can vary according to the uses to which the device 32 is put. For example, in the illustrated application, and as best shown in FIG. 6, the piston outlet passage 112 can have an interior diameter of approximately 0.63 inch (dimension D1 in FIG. 6), and the actuator member 144 can have an effective width of approximately 0.60 inch (dimension D2 in FIG. 6). Thus, when the actuator member 144 is locked in the midportion of the passage 112 (as shown in FIG. 6) there is a total distance of 0.015 inch (dimension D3 in FIG. 6) between each side of the actuator member 144 and the adjacent piston passage sidewall 114.

In this arrangement, the outward end of each pin 132 and 138 can extend approximately 0.007 inch (dimension D4 in FIG. 6) into the piston passage 112 when the pin 132 and 138 is in its normal position. Thus, actuator movement of 0.008 inch in either direction away from its mid-position (dimension D5 in FIG. 6) serves to bring it into initial contact with the outward end 136 and 142 of either pin 132 or 138. Subsequent movement of the actuator member 144 through the remaining 0.007 inch serves to move the pin 132 and 138 into its displaced position and open the associated outlet valve 128 and 130, at the same time bringing the actator member 144 into operative contact with the sidewall 114. Movement of the steering tiller 28 will thus virtually instanteously be transmitted into movement of the steering leg 22 to steer the boat.

The actuating and locking device 32 as herein described is adapted not only for marine use, but also for non-marine use as well. In this regard, the device 32 is broadly applicable for use in any linkage arrangement in which either rotational or nonrotational movement of a drive member is transmitted into either rotational or nonrotational movement of a driven member.

In some installations, the arrangement can be such that the piston 66 moves along an axis which is inclined to the horizontal. Consequently, air which can be intermingled with the oil may tend to collect in the uppermost part of the uppermost one of the end cavities 63 and 65. Thus, there is shown in FIG. 9, a preferred and modified construction which is designed to bleed any collected air from the device 32 and, additionally, to provide for filtering of oil inflowing into the device 32, and to provide the previously mentioned check valves 101 and 103 with fast and reliable action.

While for purposes of description, the modified construction has been illustrated only in connection with the end cavity 63, it is, of course obvious that both end cavities 63 and 65 could be similarly modified. While other constructions could be employed, in the construction illustrated in FIG. 9, the modified and preferred embodiment includes an end wall cap 201 partially defining the cavity 63 and means for bleeding air from the uppermost part of the end cavity 63, which means comprises a bleed pipe member 203 which extends fixedly inwardly of the cavity 63 from the end wall cap 201. The bleed pipe member 203 extends into a sleeve 205 which is fixedly located in the first branch passage or bore 116 and which has one end received, in part, within a counterbore 207 formed in a keeper 209 which is also fixed in the branch passage or bore 116 and which includes a central aperture 211 and a cylindrical flange 208 which defines the counterbore 207 receiving the adjacent end of sleeve 205.

Means are provided for sealing the interface between the sleeve 205 and the bleed pipe member 203. While various arrangements could be employed, in the illustrated construction, such means comprises a sealing ring 215 which is fabricated of relatively soft material, such as rubber or plastic, which wipingly engages the outer surface of the bleed pipe member 203, and which is secured between the keeper 209 and the adjacent end of the sleeve 205 located within the counterbore 207 of the keeper 209. Thus, fluid flow in the vicinity of the outer surface of the bleed pipe member 203 between the inner end of the bore or branch passage 116 and the end cavity 63 is precluded.

The bleed pipe member 203 includes an axial bore 221 which, at its inner end, communicates with the bore or branch passage 116, and which, at its other end, is blind except as will be explained. Also forming part of the bleed pipe member 203 is a radially extending branch portion 223 having an axially bore 225 which communicates with the blind end of the bleed pipe bore 221 and which terminates in and communicates with the uppermost part of the end cavity 63.

Accordingly, movement of the piston 66 toward the end wall cap 201, initially forces any air which may be present in the uppermost portion of the end cavity 63 into the bleed pipe bore 225 and subsequently forces oil from the end cavity 63 into the bleed pipe bore 225 so as to drain air and oil into the branch passageway or bore 116 for delivery in the general manner heretofore explained.

Referring further to the inlet openings 100 and 102, each of the inlet openings 100 and 102 is preferably provided with a filter 231 to prevent inflow with the oil of grit into the device 32.

Referring to the inlet check valve 101 and 103, these check valves are preferably constructed of lightweight material so as to facilitate fast and reliable action in response to relatively small pressure changes.

More particularly, only the check valve 101 is shown in FIG. 9, and includes a flat disc member 241 having a plurality of angularly spaced and axially extending peripheral legs 243 (one shown) which engage a cylindrical wall 245 of an axially extending counterbore in the end wall cap 201 so as to guide movement of the disc member 241 toward and away from a valve seat 249 on the end wall cap 201.

The disc member is biased into engagement with the valve seat 249 by a light spring 251 which also bears against an annular washer 253 having a central opening 254 and a plurality of angularly spaced and radially extending peripheral legs 255 engageable with the cylindrical wall 245. In turn, the washer 253 is engaged against a spring-biased retaining ring 257 seated in a groove 259 in the axially extending cylindrical wall 245 of the end wall cap 201.

In order to facilitate fluid flow when the check valve 101 is open, the end wall cap 201 is relieved in the area 261 adjacent to the junction of the valve seat 249 and the axially extending cylindrical wall 245. Such relief facilitates flow through the angularly separated spaces between the angularly spaced legs 243 of the disc member 241. The angular spacing of the legs 255 of the supporting washer 253 also facilitate flow through the inlet opening 100 and into the end cavity 63 in response to the presence of a relatively small negative pressure in the end cavity 63 consequent to movement of the piston 66 away from the end wall cap 201.

Particularly as compared to prior mechanical arrangements for preventing stern leg steering movement in response to forces originating at the stern leg, the disclosed hydraulic arrangement advantageously offers a smooth transition from a holding mode for preventing steering movement in response to forces generated at the stern leg to an operating mode initiated by the user, and particularly when the operating mode is in the same direction as would be caused by the forces generated at the stern legs.

In addition, the disclosed hydraulic arrangement can provide shock absorption against feed-back to the steering wheel of large steering loads from the stern leg in the event of partial failure of the arrangement.

Still further in addition, the disclosed construction advantageously protects against excessively fast steering action, particularly when operating at high speeds, by limiting the rate of stern leg turning movement by reason of the resistance which is incorporated in the arrangement to hydraulic flow.

Various of the features of the invention are set forth in the following claims.

We claim:

1. A marine propulsion device comprising a movable steering member, a movable steerable member including a propeller, and steering means operatively connected with said steering member and said steerable member and including a cylinder having opposite first and second end portions, a piston operatively connected with said steering member for reciprocative movement within said cylinder between said first and second end portions in response to movement of said steering member and for permitting movement of said steerable member in response to movement of said steering member, supply means communicating with each of said first and second cylinder end portions and adapted for communication with a sump, said supply means being operative, in response to steering member movement effecting movement of said piston away from one of said cylinder end portions, for conducting hydraulic fluid from the sump into said one of said cylinder end portions, and discharge means communicating with each of said first and second cylinder end portions and adapted for communication with a sump, said discharge means being operative, in the absence of movement of said steering member, for blocking hydraulic fluid flow from each of said cylinder end portions so as thereby to lock said piston against movement in said cylinder, and being further operative, in response to movement of said steering member effecting movement of said piston away from said one cylinder end portion, for affording hydraulic fluid flow from the other of said first and second cylinder end portions to the sump so as thereby to free said piston for movement within said cylinder.

2. A marine propulsion device according to claim 1 wherein said discharge means includes conduit means operative for conducting hydraulic fluid from said respective one of said cylinder end portions to the sump in response to piston movement toward said respective cylinder end portion, and locking valve means in said conduit means operative between a closed position for locking said piston against movement in said cylinder by blocking the conduction of hydraulic fluid by said conduit means from each of said first and second cylinder end portions, a first open position for freeing said piston for movement toward said first cylinder end portion by affording the conduction of hydraulic fluid from said first cylinder end portion by said conduit means, and a second open position for freeing said piston for movement toward said second cylinder end portion by affording the conduction of hydraulic fluid from said second cylinder end portion by said conduit means, and wherein said steering means includes a drive member connected with said steering member and operative for movement in a first direction and a second direction in response to steering member movement, and linkage means connecting said drive member with said piston and said locking valve means and being operative, in the absence of movement of said drive member, for disposing said locking valve means toward said closed position, being further operative, in response to movement of said drive member in said first direction, for moving said locking valve means from said closed position to said first open position and for moving said piston toward said first cylinder end portion, and being further operative, in response to movement of said drive member in said second direction, for moving said locking valve means from said closed position to said second open position and for moving said piston toward said second cylinder end portion.

3. A marine propulsion device according to claim 1 wherein said steering means includes an output member rotatable about an axis, means operatively connecting said output member with said steerable member for moving said steerable member in response to rotation of said output member about said axis, and a driven linkage operatively connected with said piston and said output member for transforming reciprocative movement of said piston into rotational movement of said output member about said axis.

4. A marine propulsion device according to claim 3 wherein said linkage includes means defining a series of gear teeth on said piston, and gear means on said output member operative for engagement with said piston gear teeth for rotating said output member in response to piston reciprocation.

5. A marine propulsion device according to claim 3 or 4 wherein said steering means includes a steering gear operatively connected with said steering member for rotation about an axis in response to movement of said steering member, and drive means operatively connected with said steering gear and said piston for transforming rotation of said steering gear about said steering gear axis into reciprocative movement of said piston.

6. A marine propulsion device according to claim 5 wherein said drive means includes an idler gear operatively connected with said steering gear for rotation relative to said rotational axis of said output member in response to rotation of said steering gear, a drive member operatively connected with said idler gear for movement in a first direction and a second direction in response to rotation of said idler gear, and linkage means operatively connecting said drive member with said piston and said discharge means for effecting piston movement toward said first cylinder end portion in response to movement of said drive member in said first direction and for effecting piston movement toward said second cylinder end portion in response to movement of said drive member in said second direction.

7. An actuating and locking device comprising a cylinder having opposite first and second end portions, a piston mounted for reciprocative movement within said cylinder between said first and second end portions, drive means connected with said piston and operatively movable for effecting piston reciprocation, supply means communicating with each of said first and second cylinder end portions and adapted for communication with a sump, said supply means being operative, in response to drive means movement effecting movement of said piston away from one of said cylinder end portions, for conducting hydraulic fluid from the sump into said one of said cylinder end portions, discharge means communicating with each of said first and second cylinder end portions and adapted for communication with a sump, said discharge means being operative, in the absence of movement of said drive means, for blocking hydraulic fluid flow from each of said cylinder end portions so as to thereby lock said piston against movement in said cylinder, and being further operative, in response to drive means movement effecting movement of said piston away from said one cylinder end portion, for affording the other of said first and second cylinder end portions to the sump so as thereby to free said piston for movement within said cylinder, and driven means operatively connected with said drive means for movement in response to movement of said drive means when hydraulic fluid flow from said cylinder to said sump is afforded.

8. An actuating and locking device according to claim 7 wherein said discharge means includes conduit means operative for conducting hydraulic fluid from said respective one of said cylinder end portions to the sump in response to piston movement toward said respective cylinder end portion, locking valve means in said conduit means operative between a closed position for locking said piston against movement in said cylinder by blocking the conduction of hydraulic fluid by said conduit means from each of said first and second cylinder end portions, a first open position for freeing said piston for movement toward said first cylinder end portion by affording the conducion of hydraulic fluid from said first cylinder end portion by said conduit means, and a second open position for freeing said piston for movement toward said second cylinder end portion by affording the conduction of hydraulic fluid from said second cylinder end portion by said conduit means, wherein said drive means includes a drive member operative for movement in a first direction and a second direction, and linkage means connecting said drive member with said piston and said locking valve means and being operative, in the absence of movement of said drive member, for disposing said locking valve means toward said closed position, being further operative, in response to movement of said drive member in said first direction, for moving said locking valve means from said closed position to said first open position and for moving said piston toward said first cylinder end portion, and being further operative, in response to movement of said drive member in said second direction, for moving said locking valve means from said closed position in said second open position and for moving said piston toward said second cylinder end portion.

9. A device according to claim 2 or 8 wherein said conduit means includes means defining an outlet opening in said cylinder generally intermediate said first and second cylinder end portions and communicating with the sump, outlet conduit means in said piston communicating with said cylinder outlet opening for conducting hydraulic fluid from said first cylinder and portion to said cylinder outlet opening in response to piston movement toward said first cylinder end portion and for conducting hydraulic fluid from said second cylinder end portion to said cylinder outlet opening in response to piston movement toward said second cylinder end portion, and wherein said locking valve means is operative in said outlet conduit means between said closed position, said first open position and said second open position.

10. A device according to claim 9 wherein said outlet conduit means includes an outlet passage in said piston communicating with said cylinder outlet opening during piston movement between said first and second cylinder end portions, a first branch passage in said piston communicating with said piston outlet passage and said first cylinder end portion for conducting hydraulic fluid from said first cylinder end portion to said cylinder outlet opening through said piston outlet passage in response to piston movement toward said first cylinder end portion, and a second branch passage in said piston communicating with said piston outlet passage and said second cylinder end portion for conducting hydraulic fluid from said second cylinder end portion to said cylinder outlet opening through said piston outlet passage in response to piston movement toward said second cylinder end portion, wherein said locking valve means includes first outlet valve means in said first piston branch passage and second outlet valve means in said second piston branch passage, each of said first and second outlet valve means being independently operative between a closed position blocking the conduction of hydraulic fluid by said respective piston branch passage and an open position permitting the conduction of hydraulic fluid by said respective piston branch passage, and wherein said linkage means is operative, in the absence of movement of said drive member, for disposing each of said first and second outlet valve means toward said respective closed position, thereby corresponding to said closed position of said locking valve means, is further operative, in response to movement of said drive member in said first direction, for moving said first outlet valve means from said closed to said open position, thereby corresponding to said first open position of said locking valve means, and is further operative, in responsive to movement of said drive member in said second direction, for moving said second outlet valve means from said closed position to said open position, thereby corresponding to said second open position of said locking valve means.

11. A device according to claim 10 wherein said linkage means includes first and second pin means connected with, respectively, said first and second outlet valve means, each of said first and second pin means being independently movable between a normal position and a displaced position and operative for moving said associated first and second outlet valve means between said closed and open positions in response to movement of said respective pin means between said normal and displaced position, and actuator means connected with said drive member and operative, in responsive to movement of said drive member in said first direction, for moving said first pin means from said normal to said displaced position and further operative, in response to movement of said drive member in said second position, for moving said second pin means from said normal to said displaced position.

12. A device according to claim 11 wherein said linkage means includes means yieldably biasing each of said first and second outlet valve means toward said closed position, and wherein each of said first and second pin means is operative for moving said respective outlet valve means from said closed position to said open position against the action of said biasing means in response to movement of said respective pin means from said normal to said displaced position.

13. A device according to claim 12 wherein said outlet passage in said piston extends generally transversely of the path of piston reciprocation and includes a sidewall, wherein said first piston branch passage includes a first port in said sidewall and extends from said first port generally axially of the path of piston reciprocation toward said first cylinder end portion, wherein said second piston branch passage includes a second port in said sidewall generally diametrically spaced from said first port, said second piston branch passage extending from said second port generally axially of the path of piston reciprocation toward said second cylinder end portion, and wherein said actuator means is movable in said piston outlet passage between said first and second ports in response to movement of said drive member in said first and second directions.

14. A device according to claim 13 wherein said first pin means includes an end extending through said first port outwardly into said piston outlet passage when said first pin means is in said normal position, wherein said second pin means includes an end extending through said second port outwardly into said piston outlet passage when said second pin means is in said normal position, and wherein said actuator means is operative, in response to movement of said drive member in said first direction, for movement in said piston outlet passage toward said first port and into engagement with said end of said first pin means to move said first pin means from said normal to said displaced position and is further operative, in response to movement of said drive member in said second direction, for movement in said piston outlet passage toward said second port and into engagement with said end of said second pin means to move said second pin means from said normal to said displaced position.

15. A device according to claim 14 wherein said actuator means is operative, in response to movement of said drive member in said first direction, for engaging said sidewall adjacent to said first port to effect movement of said piston toward said first cylinder end portion and is further operative, in response to movement of said drive member in said second direction, for engaging said sidewall adjacent to said second port to effect movement of said piston toward said second cylinder end portion.

16. A device according to claim 2 or 8 wherein said supply means includes means defining an inlet opening in each of said first and second cylinder end portions communicating with the source of hydraulic fluid, and inlet check valve means in each of said inlet openings and operative between a normally closed position, blocking the conduction of hydraulic fluid from said cylinder end portions through said associated inlet openings, and an open position, permitting the conduction of hydraulic fluid into said respective one of said cylinder end portions through said associated inlet opening in response to piston movement away from said respective one of said cylinder end portions.

17. A device according to claims 1 or 7 wherein said discharge means include means for bleeding air from at least one of said first and second cylinder end portions in response to movement of said piston towards said one cylinder end portion.

18. A device according to either of claims 1 or 7 wherein said supply means includes means for filtering hydraulic fluid entering said first and second cylinder end portions.

19. A device according to either of claims 1 or 7 wherein said supply means includes check valve means for normally preventing flow from said first and second cylinder end portions and for affording flow into said first and second cylinder end portions in response to a low pressure therein.

20. A device in accordance with claim 19 wherein said check valve means respectively include a disc shaped valve member.

* * * * *

UNITED STATES PATENT AND TRADEMARK OFFICE

CERTIFICATE OF CORRECTION

PATENT NO. : 4,416,637

DATED : November 22, 1983

INVENTOR(S) : Gerald E. Kashmerick, et al.

It is certified that error appears in the above-identified patent and that said Letters Patent are hereby corrected as shown below:

Column 3, line 58, "axis" should be -- axial --.

Column 6, line 57, after "adjacent", insert -- piston --.

Column 7, line 41, "affored" should be -- afford --.

Column 8, line 50, "actator" should be -- actuator --.

Column 12, line 40, after "affording", insert -- hydraulic fluid flow from --.

Column 12, line 59, "conducion" should be -- conduction --.

Column 13, line 11, "in" should be -- to --.

Column 13, line 20, "and" should be -- end --.

Signed and Sealed this

*Thirteenth* Day of *August 1985*

[SEAL]

*Attest:*

DONALD J. QUIGG

*Attesting Officer*

*Acting Commissioner of Patents and Trademarks*